US005920046A

United States Patent [19]

Takagi

[11] Patent Number: 5,920,046

[45] Date of Patent: Jul. 6, 1999

[54] INCLINATION DETECTOR FOR VEHICLE CAPABLE OF DETECTING INCLINATION DIRECTION

[75] Inventor: Akira Takagi, Chita, Japan

[73] Assignee: Denso Corporation, Kariya, Japan

[21] Appl. No.: 09/145,175

[22] Filed: Sep. 1, 1998

[30] Foreign Application Priority Data

Sep. 2, 1997 [JP] Japan ..... 9-254368

[51] Int. Cl.[6] ..... H01H 35/02

[52] U.S. Cl. ..... 200/61.48; 200/52 A; 200/61.52; 200/61.45 M

[58] Field of Search ..... 200/61.45 R, 61.48, 200/61.52, 61.45 M, 52 A, 61.83, 61.62; 180/282; 73/1.75; 340/429, 440, 689

[56] References Cited

U.S. PATENT DOCUMENTS

| | | | |
|---|---|---|---|
| 3,961,145 | 6/1976 | Halbeck | 200/155 A |
| 4,188,517 | 2/1980 | Narita et al. | 200/61.45 R |
| 4,362,913 | 12/1982 | Kumita et al. | 200/61.45 R |
| 4,496,809 | 1/1985 | Faust et al. | 200/61.45 R |
| 4,668,846 | 5/1987 | Klumpp | 200/61.45 R |
| 4,703,315 | 10/1987 | Bein et al. | 340/689 |
| 4,980,526 | 12/1990 | Reneau | 200/61.45 M |
| 5,005,861 | 4/1991 | Breed et al. | 280/734 |
| 5,012,050 | 4/1991 | Sewell | 200/61.45 R |
| 5,034,580 | 7/1991 | Tada et al. | 200/61.45 R |
| 5,192,838 | 3/1993 | Breed et al. | 200/61.45 R |
| 5,233,141 | 8/1993 | Breed | 200/61.45 |
| 5,285,031 | 2/1994 | Schueneman | 200/61.48 |
| 5,393,944 | 2/1995 | Manandhar et al. | 200/61.45 R |
| 5,477,428 | 12/1995 | Brown et al. | 362/80 |

FOREIGN PATENT DOCUMENTS

| | | | |
|---|---|---|---|
| 2-168525 | 6/1990 | Japan | H01H 35/14 |

*Primary Examiner*—Michael A. Friedhofer
*Attorney, Agent, or Firm*—Pillsbury Madison & Sutro LLP

[57] ABSTRACT

An inclination detector has a mass rotating in the first and second directions, a pair of rotors, first and second moving contacts and first and second stationary contacts. When the inclination detector inclines to the left, torque is applied to a weight center of the mass. As a result, the mass and the rotors rotate in the first direction. This makes the first moving contact to make contact with the first stationary contact. At this time, a left-inclination detection signal is output. The second moving contact is kept away from the second stationary contact. When the inclination detector inclines to the right, the first moving contact is kept away from the first stationary contact, while the second moving contact makes contact with the second stationary contact so that a right-inclination detection signal is output. Thus, the inclination direction is detected.

10 Claims, 5 Drawing Sheets

INCLINATION DETECTOR FOR VEHICLE CAPABLE OF DETECTING INCLINATION DIRECTION

CROSS-REFERENCE TO RELATED APPLICATION

This application relates to and incorporates herein by reference Japanese Patent Application No. Hei. 9-254368 filed on Sep. 2, 1997.

BACKGROUND OF THE INVENTION

1. Field of the Invention

The present invention relates to an inclination detector for detecting that an inclination angle exceeds a preset value. The present invention is applied to a vehicle overturn detection device for detecting a transition state to overturn of the vehicle by detecting an inclination angle of the vehicle. The vehicle overturn detection device is used to determine an activation timing of a safety device for protecting passengers when the vehicle overturns.

2. Related Art

As shown in FIG. 6, a conventional inclination detector 200 has a cylinder-shaped mass 203 and a cylinder-shaped magnet 202 disposed inside the mass 203. The magnet 202 and the mass 203 are elastically biased by a spring 204 upwardly. As a result, the initial position of the magnet 202 and the mass 203 is determined by balance of the biasing force of the spring 204 and the gravitational force acting to the magnet 202 and the mass 203. A pole-shaped lead switch 201 is inserted into a hole 202*a* of the magnet 202 as an axis. The inclination detector 200 is attached to the vehicle in such a manner that the axis-direction of the inclination detector 200 substantially corresponds to the vertical direction of the vehicle. When the vehicle inclines, the biasing force caused by the spring 204 becomes larger than component force toward the spring 204 of the gravitational force acting to the magnet 202 and the mass 203. As a result, the magnet 202 and the mass 203 move toward the lead switch 201. When the inclination angle of the vehicle reaches a preset value, the magnet 202 and the mass 203 move to a preset position where contacts of the lead switch 201 are closed; thereby detecting the overturn transition state of the vehicle.

However, the above-mentioned inclination detector 200 can not detect a direction of inclination. Therefore, when the inclination detector 200 is used to detect the overturn transition state of the vehicle, the detector 200 can not discriminate whether the vehicle is going to overturn on the right side or the left side with respect to a running direction of the vehicle. Further, the magnet 202 and the mass 203 may move due to vibration or shock generated during driving of the vehicle, resulting in an instability of a detection signal.

SUMMARY OF THE INVENTION

In view of the foregoing problems, it is an object of the present invention to provide an inclination detector which detects not only an inclination angle but also an inclination direction and outputs a highly-stabilized detection signal.

According to the present invention, a mass in an inclination detector is rotatably supported by a shaft at a position offset from a weight center of the mass. A pair of rotors formed to have a plurality of cam portions are disposed on both sides of the mass in a point-symmetrical way with respect to the mass, and have the same rotation axis as the mass to rotate together with the mass. A pair of moving contacts, each of which is made of a plate spring, contact the surfaces of the cam portions formed in the rotors, respectively, and bias the rotors from the opposite direction to each other. A pair of stationary contacts are disposed away from the corresponding moving contact with a preset contact gap. When the inclination detector inclines to the left or the right in a rotational direction of the mass, the mass and the rotors rotate together. When the inclination angle of the inclination detector reaches a preset value, only either one of the moving contacts makes contact with the corresponding stationary contact so that a left or right inclination detection signal is output, while the other moving contact does not make contact with the corresponding stationary contact. Thus, the direction toward which the inclination detector inclines is detected.

Preferably, the inclination detector is provided with at least one of a magnetic member for applying magnetic force to the mass, and an inertial member having the same rotation axis as the mass to rotate together with the mass and a relatively small eccentric mass moment. This prevents the mass from rotating due to vibration or shock applied to the vehicle, resulting in a stabilized inclination detection signal.

Preferably, either one of the moving contact and the stationary contact has a contact portion protruding toward the other one. This ensures contact between the moving contact and the stationary contact.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Figure 1B:
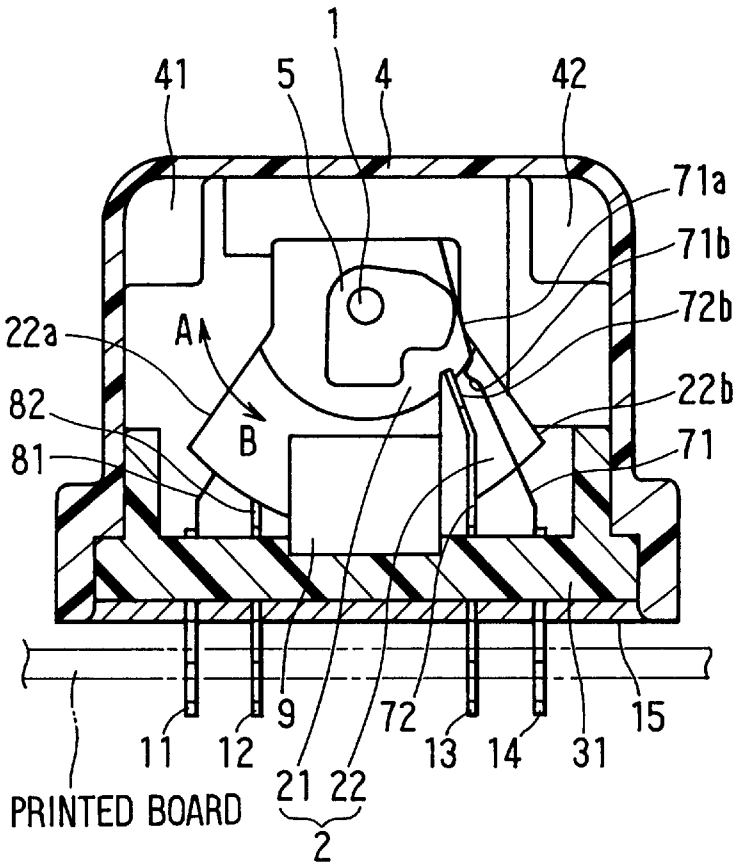
FIG. 1B is a cross-sectional view when viewed from the right side showing the inclination detector according to the first embodiment.

Preferred embodiments of the present invention are described hereinafter with reference to the accompanying drawings.

First Embodiment

In a first embodiment, as shown in FIG. 1, an inclination detector 100 has a shaft 1, and is mounted on a vehicle in such a manner that a longitudinal direction of the shaft 1 corresponds to a longitudinal direction of the vehicle to detect a vehicle overturn. The inclination detector 100 has a casing formed by press-fitting a housing 3 made of resin into a cover 4. Adhesive 15 is sufficiently applied to the exterior surface of the housing 3 attached to the cover 4 so that the inclination detector 100 is hermetically sealed. The housing 3 has a base 31 and a pair of columns 32 facing to each other. Each of the columns 32 has a groove (not shown) on the end portion. The both ends of the shaft 1 are secured to the columns 32 through the groove. The shaft 1 supports a mass 2 and rotors 5, 6 so that the mass 2 and the rotors 5, 6 rotate freely around the shaft 1. Stoppers 41, 42 are attached to the cover 4 to protrude inside the cover 4 in such a manner that the stoppers 41, 42 are located on a rotation path of the mass 2. The mass 2 hits the stoppers 41, 42 during rotation, whereby the stoppers 41, 42 prevent the mass 2 from excessively rotating. Plate-shaped moving contacts 71, 81 and stationary contacts 72, 82 are arranged in a standing condition on the base 31 of the housing 3. The moving contact 71 and the stationary contact 72 make one contact pair, while the moving contact 81 and the stationary contact 82 make the other contact pair.

Figure 2:
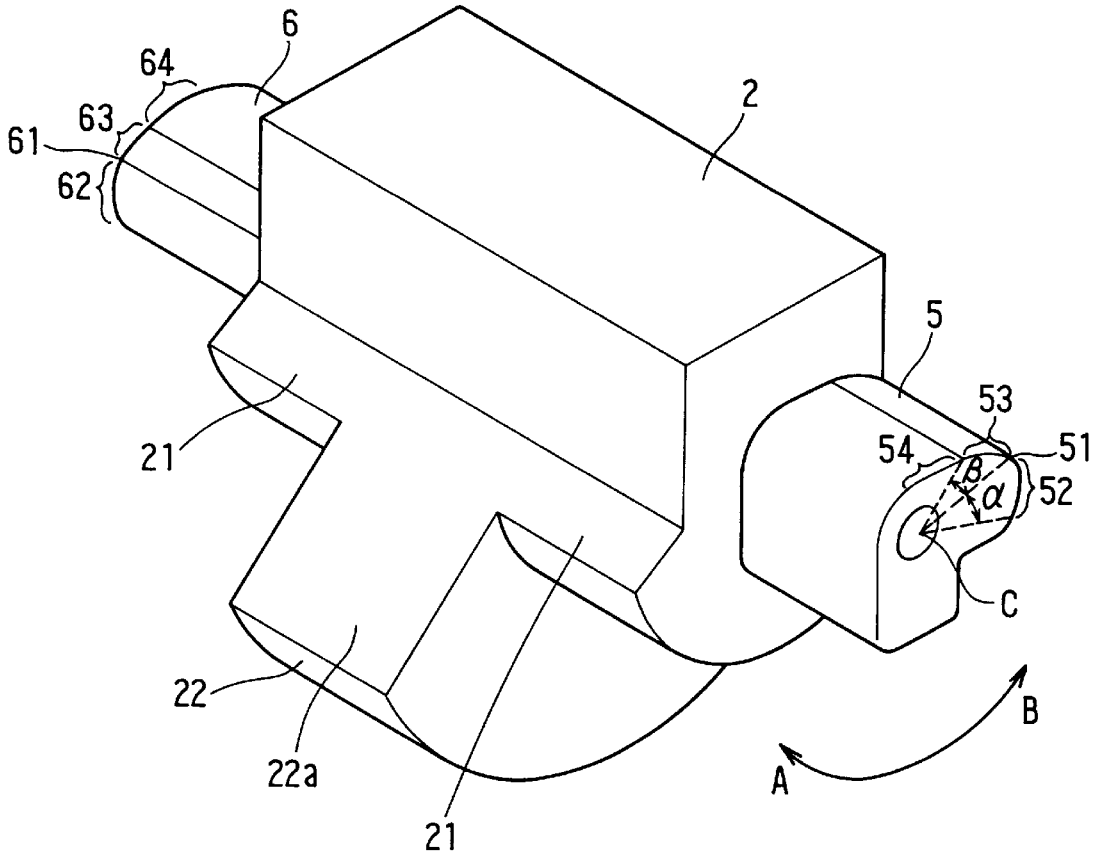
FIG. 2 is a perspective view showing a mass and rotors of the inclination detector according to the first embodiment.

Referring to FIG. 2, the mass 2 is formed by machining a metal plate, and has an eccentric portion 22 in which the rotation axis does not pass through the weight center, and inertial portions 21 integrally formed on both sides of the eccentric portion 22, in which the rotation axis substantially passes through the weight center.

As shown in FIGS. 1, 2, the rotors 5, 6 made of resin are formed on both sides of the mass 2 in the axial direction of the shaft 1 so that the rotors 5, 6 share the shaft 1 with the mass 2. Therefore, the rotors 5, 6 rotate around the shaft 1 in synchronization with the mass 2. Further, the rotors 5, 6 are disposed in a point-symmetrical manner with respect to the center point of the mass 2, and elastically biased by the moving contacts 71, 81 at contact points 51, 61, respectively. Thus, substantially the same biasing force in the opposite direction is applied to the contact points 51, 61 by the moving contacts 71, 81; therefore, the contact points 51, 61 are neutral positions of contact between the rotors 5, 6 and the moving contacts 71, 81, respectively.

Referring to FIG. 2, the rotors 5, 6 have first cam portions 52, 62 extending downwardly from the contact points 51, 61 in an area of a preset angle a, and having a curved surface with the same diameter as that of the contact points 51, 62. The rotors 5, 6 also have second cam portions 53, 63 extending upwardly from the contact points 51, 61 in an area of a preset degree β, and having a diameter gradually decreasing from the diameter of the contact points 51, 61. Therefore, a direction of torque applied to the rotors 5, 6 by the moving contacts 71, 81 changes according to the rotation direction of the rotors 5, 6.

That is, when the rotors 5, 6 rotate in a direction A in FIG. 2 due to inclination of the vehicle, the moving contact 81 biases the first cam portion 62 and the biasing force caused by the moving contact 81 heads for the shaft center C. Therefore, the moving contact 81 does not apply torque with respect to rotation of the rotor 6. Further, the moving contact 81 is not displaced by rotation of the rotor 6 because the first cam portion 62 has a curved surface of a constant diameter with respect to the shaft center C. On the other hand, because the moving contact 71 biases the second cam portion 53, biasing force caused by the moving contact 71 does not head for the shaft center C. Therefore, the moving contact 71 applies torque such that the rotor 5 is rotated in the direction A. Further, due to the gradually-decreasing diameter of the second cam portion 53, the moving contact 71 gradually moves toward the stationary contact 72 as the rotor 5 rotates, and eventually makes contact with the stationary contact 72 when the rotation angle of the rotor 5 reaches a preset value. The angle of inclination of the vehicle causing the vehicle overturn is detected by detecting the contact state between the moving contacts 71, 81 and the stationary contacts 72, 82.

Further, the rotors 5, 6 have third cam portions 54, 64 extending upwardly from the second cam portions 53, 63. The third cam portions 54, 64 are formed in such a manner that the rotors 5, 6 do not touch the moving contacts 71, 81 during rotation after the moving contacts 71, 81 make contact with the stationary contacts 72, 82. Therefore, once the moving contacts 71, 81 make contact with the stationary contacts 72, 82, biasing force applied to the stationary contacts 72, 82 by the moving contacts 71, 81 is not influenced even if the rotors 5, 6 continue to rotate. That is, only biasing force caused by the moving contacts 71, 72 is applied to the stationary contacts 72, 82, whereby the moving contacts 71, 72 stably bias the stationary contacts 72, 82.

Figure 3:
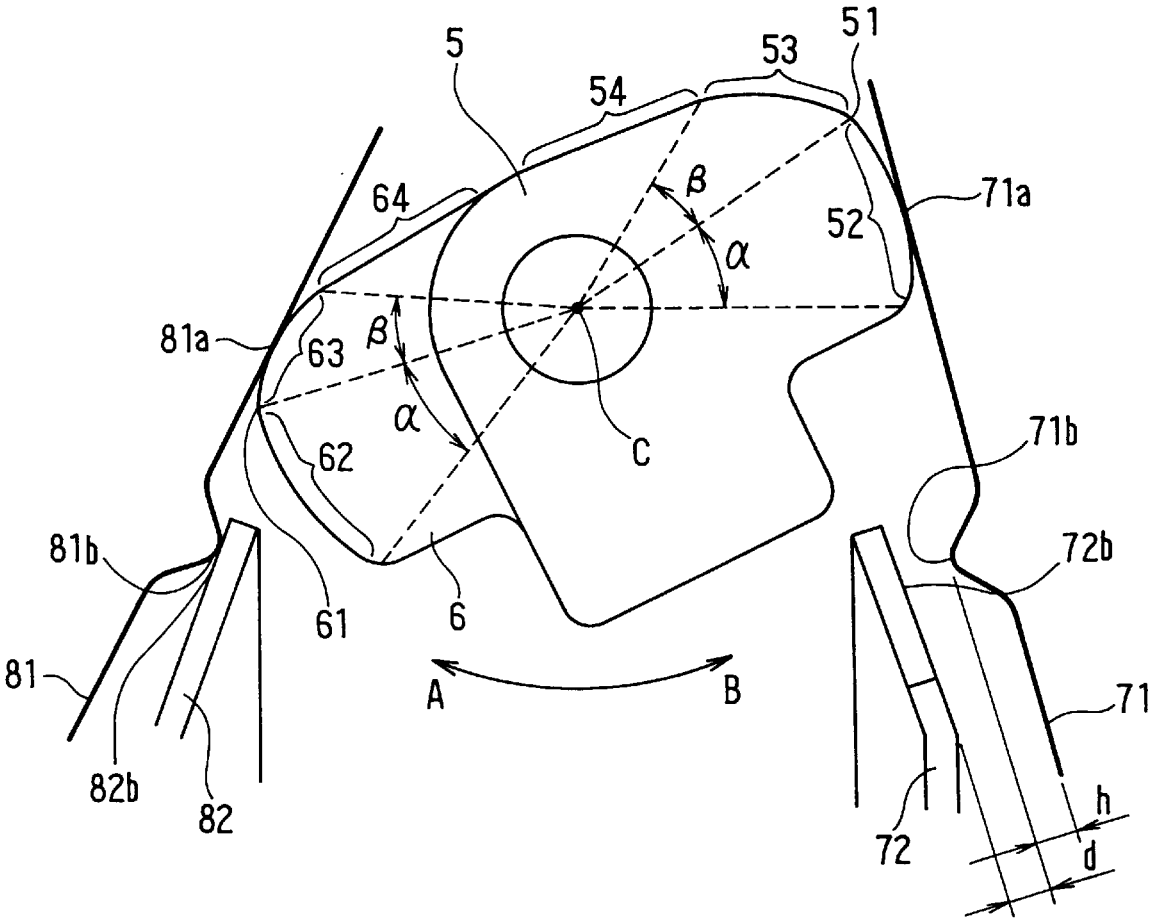
FIG. 3 is an explanatory schematic view showing a relation between rotors, moving contacts and stationary contacts of the inclination detector according to the first embodiment.

Referring to FIG. 3, the stationary contacts 72, 82 are respectively disposed on sides of the rotors 5, 6 rather than the moving contacts 71, 81 so that the stationary contacts 72, are biased by the moving contacts 71, 81. The moving contacts 71, 81 have contact portions 71*b*, 81*b* and the stationary contacts 72, 82 have contact portions 72*b*, 82*b*, respectively. The contact portions 72*b*, 82*b* are formed into a flat shape, and the contact portions 71*b*, 81*b* are formed into a protrusion shape with a height of h protruding toward the stationary contacts 72, 82. A predetermined contact gap d is provided between the contact portions 71*b* and 72*b*, and between the contact portions 81*b* and 82*b*, when the mass 2 and the rotors 5, 6 do not rotate (neutral position).

Referring back to FIGS. 1A, 1B, when the inclination detector 100 is in the neutral position, end portions 71*a*, 81*a* of the moving contacts 71, 81 make contact with the contact points 51, 61 of the rotors 5, 6, and elastically bias the rotors 5, 6 in the opposite direction to each other, respectively. That is, the moving contact 71 biases the rotor 5 in the left direction in FIG. 1B, and the moving contact 81 biases the rotor 6 in the right direction in FIG. 1B. The mass 2 is indirectly biased by the elastically biasing force applied 20 to the rotors 5, 6 by the moving contacts 71, 81 to be maintained at the neutral position. This prevents the mass 2 and the rotors 5, 6 from being rotated due to vibration of the vehicle or shock applied to the vehicle during driving on a bumpy road.

The contacts 71, 72, 81, 82 are secured to the base 31 of the housing 3 by insert-molding, while being made contact with the output terminals 14, 13, 12, 11, respectively. The terminals 11, 12, 13, 14 are formed to protrude from the base 31 downwardly. The contact state between the contacts 71 and 72 or between the contacts 81 and 82 is output as an inclination detection signal through the output terminals 11, 12, 13, 14. Magnets 9, 10 are disposed on both sides of the eccentric portion 22 of the mass 2 and secured to the base 31 by insert-molding.

Next, an operation of the inclination detector 100 will be described.

In a normal driving condition of the vehicle, torque applied to the rotor 5 by the moving contact 71 and torque applied to the rotor 6 by the moving contact 81 are balanced in the inclination detector 100. Further, the mass 2 has a relatively small ratio of eccentric mass moment to inertial moment due to the inertial portion 21. Therefore, the mass 2 does not rotate even when a minute acceleration is applied to the mass 2. Furthermore, magnetic force caused by the magnet 9, 10 restrains the mass 2 from rotating. Thus, the mass 2 and the rotors 5, 6 are prevented from rotating around the shaft 1 due to causes other than an overturn of the vehicle, such as vibration of the vehicle and shock applied to the vehicle during driving on a bumpy road. As a result, contact between the contacts 71 and 72 or between the contacts 81 and 82 does not occur due to these causes other than the overturn of the vehicle, thereby decreasing detection errors of the inclination detector 100.

Figure 1A:
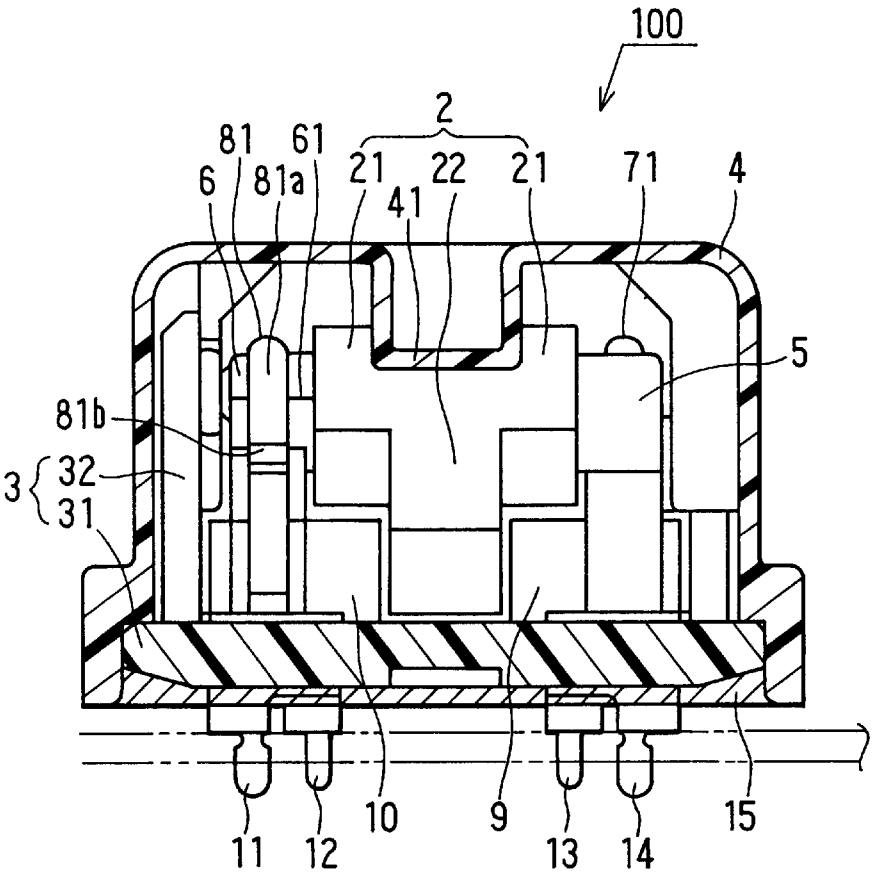
FIG. 1A is a cross-sectional view when viewed from the front side showing an inclination detector according to a first embodiment of the present invention.

When the inclination detector 100 inclines to the right to inclination of the vehicle, for example, torque is applied to the weight center of the mass 2 in the direction B in FIG. 1B. This rotates the mass 2 and the rotors 5, 6 in the direction B, as shown in FIG. 3. Therefore, the moving contact 71 separates from the contact point 51 of the rotor 5 and starts to slide on the first cam portion 52 due to rotation of the rotor 5. Since the first cam portion 52 has the same diameter as that of the contact point 51, the moving contact 71 is not displaced by rotation of the rotor 5 in the direction B, and the contact gap d between the moving contact 71 and the stationary contact 72 is maintained. Further, at this time, no torque is applied to the rotor 5 by the moving contact 71 in the either direction A or B because biasing force applied to the rotor 5 by the moving contact 71 heads for the rotation axis of the rotor 5.

On the other hand, the moving contact 81 separates from the contact point 61 and starts to slide on the second cam portion 63 due to rotation of the rotor 6 in the direction B. Since the diameter of the second cam portion 63 is gradually decreased from the diameter of the contact point 61, the moving contact 81 is displaced toward the stationary contact 82 as the rotor 6 rotates in the direction B. As a result, the contact gap d between the moving contact 81 and the stationary contact 82 is decreased. Further, torque is applied to the rotor 6 in the direction B because biasing force applied to the rotor 6 by the moving contact 81 does not head for the rotation axis of the rotor 6. When the rotor 6 rotates by a preset angle in the direction B, the contact portions 81*b* and 82*b* make contact with each other; thereby producing the overturn detection signal.

As shown in FIG. 3, the contact portions 81*b*, 82*b* make contact with each other while the contact gap d between the contact portions 71*b*, 72*b* is maintained as the rotors 5, 6 rotate in the direction B. The direction B is a positive rotation direction of the rotor 6. Thus, when the inclination detector 100 inclines to the right, only the contact state between the moving contact 81 and the stationary contact 82 changes. This contact state change causes change in current flowing between the output terminals 11, 12. That is, the change in current is used as the overturn detection signal.

When the rotors 5, 6 continue to rotate in the direction B after the contact portions 81*b* and 82*b* make contact with each other, the moving contact 81 starts to move on the third cam portion 64. Since the third cam portion 64 is so designed that the surface thereof does not make contact with the moving contact 81, all of the biasing force caused by the moving contact 81 is applied to the stationary contact 82. When the rotors 5, 6 further rotate in the direction B, the end surface 22*b* of the eccentric portion 22 of the mass 2 hits the stopper 42. Therefore, the mass 2 and the rotors 5, 6 are prevented from further rotating, and are rebounded to rotate in the opposite direction A.

When on the other hand the inclination detector 100 inclines to the left due to inclination of the vehicle, torque is applied to the weight center of the mass 2 in the direction A in FIG. 1B, thereby rotating the mass 2 and the rotors 5, 6 in the direction A. Therefore, the moving contact 81 separates from the contact point 61 of the rotor 6 and starts to slide on the first cam portion 62 due to rotation of the rotor 6. Since the first cam portion 62 has the same diameter as that of the contact point 61, the moving contact 81 is not displaced by rotation of the rotor 6 in the direction A, and the contact gap d between the moving contact 81 and the stationary contact 82 is maintained. Further, no torque is applied to the rotor 6 by the moving contact 81 in the either direction A or B because biasing force applied to the rotor 6 by the moving contact 81 heads for the rotation axis of the rotor 6.

On the other hand, the moving contact 71 separates from the contact point 51 and starts to slide on the second cam portion 53 due to rotation of the rotor 5 in the direction A. Since the diameter of the second cam portion 53 is gradually decreased from the diameter of the contact point 51, the moving contact 71 moves toward the stationary contact 72 as the rotor 5 rotates in the direction A, thereby decreasing the contact gap d between the moving contact 71 and the stationary contact 72. Torque is applied to the rotor 5 in the direction A because biasing force applied to the rotor 5 by the moving contact 71 does not head for the rotation axis of the rotor 5.

Figure 4:
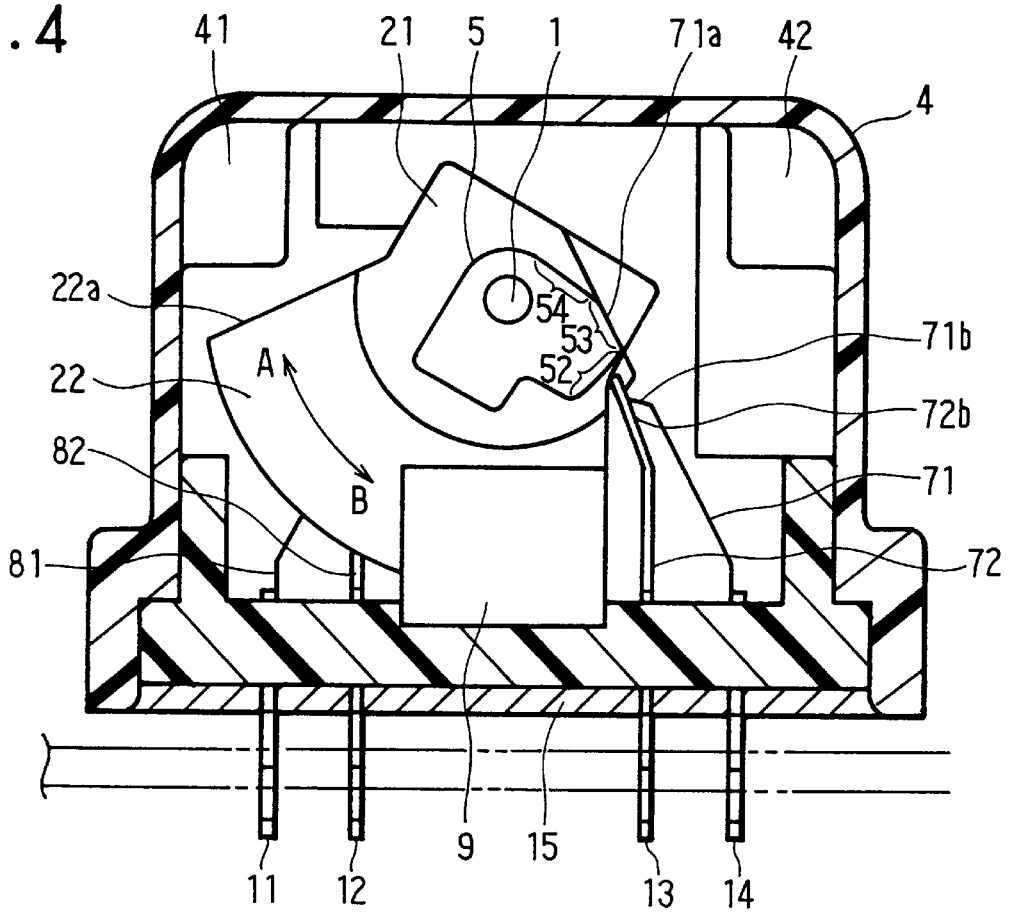
FIG. 4 is a cross-sectional view when viewed from the right side showing the inclination detector inclined to the left according to the first embodiment.
Figure 6:
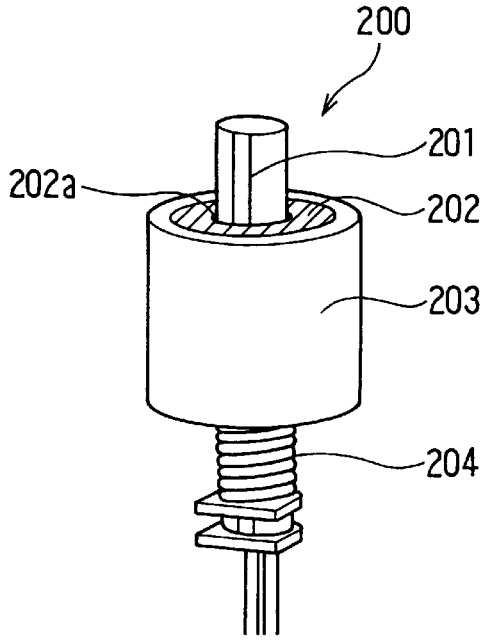
FIG. 6 PRIOR ART
FIG. 6 is a perspective view showing a conventional inclination detector.

When the rotor 5 rotates by a preset angle in the direction A, the contact portions 71*b* and 72*b* make contact with each other; thereby producing the overturn detection signal. FIG. 4 shows that the contact portions 71*b* and 72*b* make contact with each other due to rotation of the rotors 5, 6 in the direction A. The direction A is a positive rotation direction of the rotor 5. The contact gap d between the contact portions 81*b* and 82*b* is maintained. Thus, when the inclination detector 100 inclines to the left, only the contact state between the moving contact 71 and the stationary contact 72 changes. This contact state change causes change in current flowing between the output terminals 13, 14. That is, the change in current is used as the overturn detection signal.

When the rotors 5, 6 continue to rotate in the direction A after the contact portions 71*b* and 72*b* make contact with each other, the moving contact 71 starts to move on the third cam portion 54. Since the third cam portion 54 is so designed that the surface thereof does not make contact with the moving contact 71, all of the biasing force caused by the moving contact 71 is applied to the stationary contact 72. When the rotors 5, 6 further rotate in the direction A, the end surface 22*a* of the eccentric portion 22 of the mass 2 hits the stopper 41. Therefore, the mass 2 and the rotors 5, 6 are prevented from further rotating in the direction A, and are rebounded to rotate in the opposite direction B.

According to the first embodiment, the rotors 5, 6 disposed in a point-symmetric way with respect to the mass 2 are biased by the moving contacts 71, 81, and the stationary contacts 72, 82 are disposed on sides of the rotors 5, 6 rather than the moving contacts 71, 81, respectively. This enables the inclination detector 100 to detect direction toward which detector 100 inclines.

Further, the rotors 5, 6 have the first cam portions 52, 62 having a constant diameter, and the second cam portions 53, 63 having a diameter gradually decreased. Therefore, torque is applied to the mass 2 and rotors 5, 6 by the moving contacts 71, 72 in only the same direction as the rotation direction of the mass 2 and rotors 5, 6 when the mass 2 and rotors 5, 6 rotate, resulting in an excellent response of the inclination detector 100.

Furthermore, the rotors 5, 6 have the third cam portions 54, 64 which do not make contact with the moving contacts 71, 81. Therefore, after the moving contacts 71, 81 make contact with the stationary contacts 72, 82, all of the biasing force caused by each of the moving contacts 71, 81 is applied to the corresponding stationary contact 72, 82, resulting in a stabilized contact state between the moving contacts 71, 81 and the stationary contacts 72, 82.

Further, due to a small ratio of the eccentric mass moment to the inertial moment of the mass 2, and due to the magnetic force applied to the mass 2 by the magnets 9, 10, the mass 2 is prevented from rotating when a minute acceleration is applied to the mass 2. This decreases detection errors of the inclination detector 100 caused by any factor other than inclination of the vehicle.

Furthermore, the inertial portion 21 of the mass 2 and the magnets 9, 10 prevent chattering caused by contact between the mass 2 and the stoppers 41, 42 when the vehicle inclines, resulting in stabilization of the inclination detection signal.

Further, the rotation angles of the rotors 5, 6 of when either one of the moving contacts 71, 81 and the corresponding stationary contact 72, 82 make contact with each other are freely set by adjusting the contact gap d, that is, by adjusting the height h of the contact portions 71*b*, 81*b*.

Furthermore, because the magnets 9, 10 are disposed on both sides of the mass 2 so that the inertial portions 21 of the mass 2 are disposed in spaces created above the magnets 9, 10, respectively, the inclination detector 100 can be made compact.

Second Embodiment

Figure 5B:
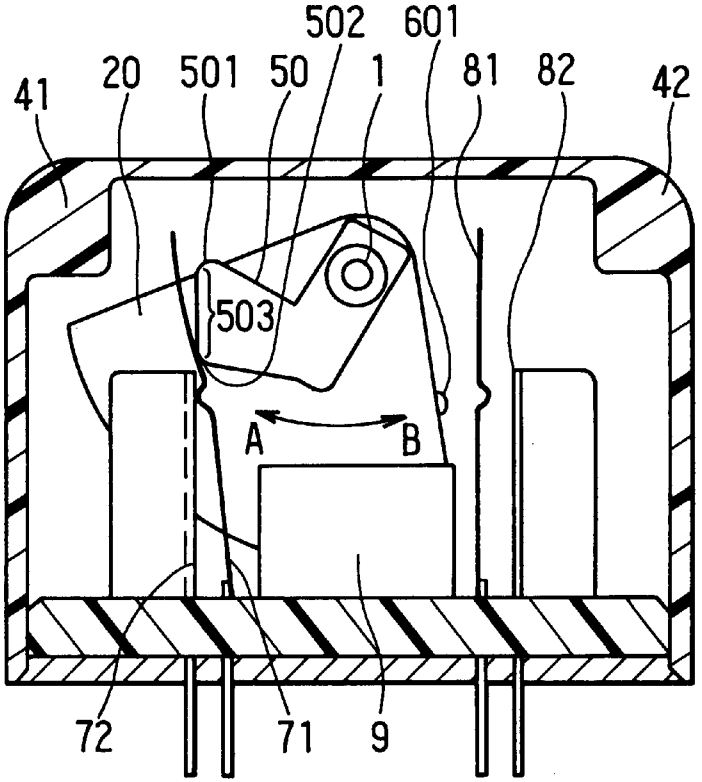
FIG. 5B is a cross-sectional view when viewed from the right side showing an inclination detector which is inclined to the left according to the second embodiment.
Figure 5A:
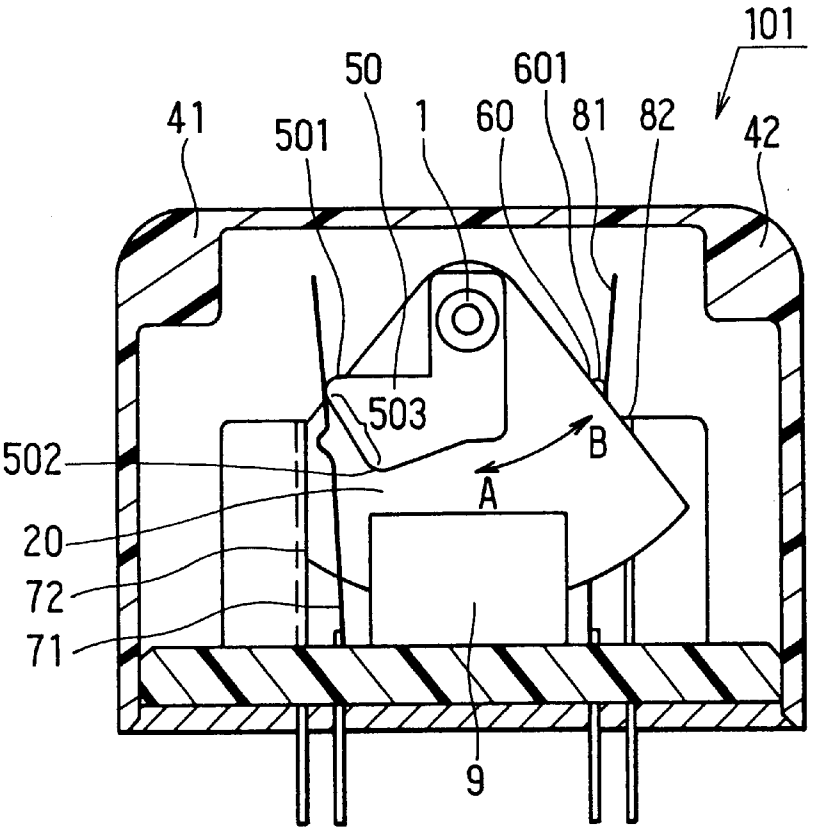
FIG. 5A is a cross-sectional view when viewed from the front side showing an inclination detector which is not inclined according to a second embodiment of the present invention.

A second embodiment of the present invention will be described with reference to FIG. 5A, 5B. In the second embodiment, the moving contacts 71, 81 are disposed on sides of rotors 50, 60 rather than the stationary contacts 72, 82, a mass 20 does not have an inertial portion, and the rotors 50, 60 have a different shape from that of the rotors 5, 6 in the first embodiment. Other features of an inclination detector 101 in the second embodiment are similar to those of the inclination detector 100 in the first embodiment. FIG. 5A shows the inclination detector 101 not inclined. FIG. 5B shows the inclination detector 101 inclined to the left by an angle larger than a preset angle, resulting in that the moving contact 71 makes contact with the stationary contact 72.

The mass 20 is supported by a shaft 1 at the point which is offset from the weight center of the mass 20. The rotors 50, 60 made of molding resin are formed on both sides of the mass 20 to share the shaft 1 with the mass 20; therefore, the rotors 50, 60 rotate around the shaft 1 in synchronization with the mass 20. The rotors 50, 60 are disposed in a point-symmetrical manner with respect to the mass 20, and are biased by the moving contacts 71, 81 at the contact points 501, 601, respectively. Thus, substantially the same biasing force in the opposite direction is applied to the contact points 501, 601 by the moving contacts 71, 81; therefore, the contact points 501, 601 are neutral positions of contact between the rotors 50, 60 and the moving contacts 71, 81.

The rotors 50, 60 have first cam portions 503, 603 having a diameter (distance from a rotational center) gradually increasing, between the contact points 501, 601 and contact points 502, 602, which are disposed below the contact points 501, 601. The portions of the rotors 50, 60 extending downwardly from the contact points 502, 602 are formed to have a diameter gradually decreasing. Further, the stationary contacts 72, 82 are disposed outside the moving contacts 71, 81 with a preset contact gap so that the stationary contacts 72, 82 are not biased by the moving contacts 71, 81, when the detector 101 does not incline.

In a normal driving condition of the vehicle, torque applied to the rotor 50 in the direction B by the moving contact 71 and torque applied to the rotor 60 in the direction. A by the moving contact 81 are balanced in the inclination detector 101. Further, rotation of the mass 20 is restrained by magnetic force caused by the magnets 9, 10. Therefore, the mass 20 and the rotors 50, 60 are prevented from rotating around the shaft 1 due to causes other than an overturn of the vehicle, such as vibration of the vehicle and shock applied to the vehicle during driving on a bumpy road. As a result, contact between the contacts 71 and 72 or between the contacts 81 and 82 does not occur due to these causes other than the overturn of the vehicle, thereby decreasing detection errors of the inclination detector 101.

When the inclination detector 101 inclines to the left, torque is applied to the weight center of the mass 20 in the direction A. The torque rotates the mass 20 and the rotors 50, 60 in the direction A, as shown in FIG. 5B. Therefore, the rotor 60 separates from the moving contact 81 while a contact gap between the moving contact 81 and the stationary contact 82 is maintained. That is, the moving contact 81 does not make contact with the stationary contact 82.

On the other hand, the rotor 50 making contact with the moving contact 71 rotates in the direction A in resistance to biasing force caused by the moving contact 71. The first cam portion 503 having a gradually-increasing diameter starts to slide on the moving contact 71 as the rotor 50 rotates in the direction A. As a result, the moving contact 71 is displaced toward the stationary contact 72. When the rotor 50 rotates a preset angle, the moving contact 71 is pressed by the rotor 50 at the contact point 502 having the largest diameter, and the moving contact 71 makes contact with the stationary contact 72, as shown in FIG. 5B. Thus, when the inclination detector 101 inclines to the left, only the contact state between the moving contacts 71 and the stationary contact 72 changes. As a result, inclination of the vehicle to the left is detected based on the overturn (inclination) detection signal.

When the rotors 50, 60 continue to rotate in the direction A after the moving contact 71 makes contact with the stationary contact 72, the moving contact 71 is continuously pressed by the rotor 50 at the contact point 502. Therefore, the contact state between the moving contact 71 and the stationary contact 72 is stabilized. Further, after the moving contact 71 makes contact with the stationary contact 72, the rotation speed of the mass 20, rotors 50, 60 in the direction. A is decreased because biasing force applied to the rotor 50 by the moving contact 71 is increased. As a result, the moving speed of the mass 20 is decreased when the mass 20 hits the stopper 41, thereby preventing chattering of the mass 20 and the stopper 41. The direction A is a positive rotation direction of the rotor 50.

When the inclination detector 101 inclines to the right, torque is applied to the weight center of the mass 20 in the direction B. The torque rotates the mass 20 and the rotors 50, 60 in the direction B. Therefore, the rotor 50 separates from the moving contact 71 while a contact gap between the moving contact 71 and the stationary contact 72 is maintained; that is, the moving contact 71 does not make contact with the stationary contact 72.

On the other hand, the rotor 60 making contact with the moving contact 81 rotates in the direction B in resistance to biasing force caused by the moving contact 81. The first cam portion 603 having a gradually-increasing diameter starts to slide on the moving contact 81 as the rotor 60 rotates in the direction B. As a result, the moving contact 81 is displaced toward the stationary contact 82. When the rotor 60 rotates a preset angle, the moving contact 81 is pressed by the rotor 60 at the contact point 602 having the largest diameter, and the moving contact 81 makes contact with the stationary contact 82. Thus, when the inclination detector 101 inclines to the right, only the contact state between the moving contact 81 and the stationary contact 82 changes. As a result, inclination of the vehicle to the right is detected.

When the rotors 50, 60 continue to rotate in the direction B after the moving contact 81 makes contact with the stationary contact 82, the moving contact 81 is continuously pressed by the rotor 60 at the contact point 602. Therefore, the contact state between the moving contact 81 and the stationary contact 82 is stabilized. Further, after the moving contact 81 makes contact with the stationary contact 82, the rotation speed of the mass 20, rotors 50, 60 in the direction B is decreased because biasing force applied to the rotor 60 by the moving contact 81 is increased. Therefore, the moving speed of the mass 20 is decreased when the mass 20 hits the stopper 42, thereby preventing chattering of the mass 20 and the stopper 42. The direction B is a positive rotation direction of the rotor 60. Thus, the inclination detector 101 in the second embodiment has the same effects as the inclination detector 100 in the first embodiment.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. An inclination detector comprising:

a shaft;

a mass rotatably supported by said shaft at a position offset from a weight center of said mass;

first and second rotors having same rotational axis as said mass to rotate together with said mass, said first and second rotors being disposed on both sides of said mass in a rotational axis direction thereof and in a point-symmetrical manner with respect to said mass, each of said first and second rotors having at least one cam portion;

first and second moving contacts made of plate springs which respectively bias said cam portions of said first and second rotors toward each other; and first and second stationary contacts disposed away from said first and second moving contacts with preset contact gaps and making contact with said first and second moving contacts displaced by said cam portions of said first and second rotors, respectively.

2. An inclination detector according to claim 1, wherein:

said first and second rotors have positive rotation directions opposite to each other;

each of said first and second moving contacts applies torque to a corresponding rotor in the positive rotation direction when said corresponding rotor rotates in the positive rotation direction; and each of said first and second moving contacts applies no torque to said corresponding rotor when said corresponding rotor rotates in a negative rotation direction opposite to the positive rotation direction.

3. An inclination detector according to claim 2, wherein:

each of said first and second rotors has a contacting point with which a corresponding moving contact makes contact when said mass and said first and second rotors are in a neutral position, and first and second cam portions;

said first cam portion has a same diameter as that of said contacting point and makes contact with a corresponding moving contact when each of said first and second rotors rotates in the negative rotation direction; and said second cam portion has a diameter gradually decreasing from that of said contacting point and makes contact with the corresponding moving contact when each of said first and second rotors rotates in the positive rotation direction.

4. An inclination detector according to claim 1, wherein:

said first and second stationary contacts are disposed on sides opposing to those toward which said first and second moving contacts are going to move due to their elasticity; and either one of said first and second moving contacts is displaced by the cam portion of a corresponding rotor and makes contact with a corresponding stationary contact when said mass and said first and second rotors rotate in either direction.

5. An inclination detector according to claim 3, wherein:

each of said first and second rotors has a third cam portion which does not make contact with said corresponding moving contact when each of said first and second rotors further rotates after said corresponding moving contact makes contact with said stationary contacts.

6. An inclination detector according to claim 1, further comprising:

a magnetic member which applies magnetic force to said mass.

7. An inclination detector according to claim 1, further comprising:

an inertial member having a same rotation axis as that of said mass and a weight center which is substantially equal to said rotation center, said inertial member rotates together with said mass.

8. An inclination detector according to claim 6, wherein:

said magnetic member is disposed on both sides of said mass in an axial direction.

9. An inclination detector according to claim 7, wherein:

said inertial member is disposed on both sides of said mass in an axial direction.

10. An inclination detector according to claim 1, wherein:

either one of said moving contacts or said stationary contacts have a contact portion protruding toward the other one.

* * * * *